United States Patent [19]

Reinert

[11] Patent Number: 4,924,671

[45] Date of Patent: May 15, 1990

[54] CONTROLLED SERIES HIGH-PRESSURE INTENSIFIERS FOR HYDRAULIC PRESS CYLINDED CIRCUIT

[75] Inventor: Michael Reinert, Lohr/Main, Fed. Rep. of Germany

[73] Assignee: Mannesmann Rexroth GmbH, Lahr, Fed. Rep. of Germany

[21] Appl. No.: 124,661

[22] Filed: Nov. 24, 1987

[30] Foreign Application Priority Data

Nov. 25, 1986-[DE] Fed. Rep. of Germany ..... 3640236

[51] Int. Cl.[5] ..... F15B 3/00

[52] U.S. Cl. ..... 60/428; 91/193; 91/275; 417/265; 417/346

[58] Field of Search ..... 417/265, 344, 346, 403, 417/2, 245, 253; 91/248, 193, 275, 277, 304; 60/423, 428, 430, 452, 479, 481, 486

[56] References Cited

U.S. PATENT DOCUMENTS

| | | | |
|---|---|---|---|
| 2,142,500 | 1/1939 | Douglas | 60/452 X |
| 2,403,912 | 7/1946 | Doll | 60/538 |
| 2,587,751 | 2/1952 | Lombard | 60/538 |
| 3,019,735 | 2/1962 | Moeller et al. | 417/344 X |
| 3,234,882 | 2/1966 | Douglas et al. | 91/275 X |
| 3,488,999 | 1/1970 | Catania | 91/275 X |
| 3,489,063 | 1/1970 | Piret | 91/275 X |
| 3,893,790 | 7/1975 | Mayer | 417/346 |
| 3,981,622 | 9/1976 | Hall et al. | 417/344 X |
| 4,004,420 | 1/1977 | Gavrilov et al. | 60/486 X |
| 4,011,723 | 3/1977 | Ross | 60/486 |
| 4,021,156 | 5/1977 | Fuchs et al. | 417/346 |
| 4,425,759 | 1/1984 | Krusche | 60/452 X |
| 4,523,895 | 6/1985 | Silva | 417/225 |
| 4,555,220 | 11/1985 | Hall et al. | 417/346 X |
| 4,735,051 | 4/1988 | Bittel et al. | 60/537 |
| 4,808,077 | 2/1989 | Kan et al. | 417/265 X |

FOREIGN PATENT DOCUMENTS

| | | | |
|---|---|---|---|
| 2416951 | 10/1974 | Fed. Rep. of Germany . | |
| 3207571 | 10/1982 | Fed. Rep. of Germany . | |
| 2175352 | 11/1986 | United Kingdom | 417/403 |

*Primary Examiner*—Robert E. Garrett
*Assistant Examiner*—George Kapsalas
*Attorney, Agent, or Firm*—Harness, Dickey & Pierce

[57] ABSTRACT

For the production and exact control and regulation of very high pressures, in particular for actuating a press, two pressure intensifiers are provided which each have a differential piston. The second pressure intensifier is connected via a shutoff valve to the first pressure intensifier and to the load or consumer. Both pressure intensifiers have a small volume compared with the volume required by the consumer. By activating the second pressure intensifier fluid can be exchanged between the consumer and the first pressure intensifier to replenish the first pressure intensifer in a pressure buildup phase and to empty the first pressure intensifier in a pressure relief phase.

21 Claims, 2 Drawing Sheets

CONTROLLED SERIES HIGH-PRESSURE INTENSIFIERS FOR HYDRAULIC PRESS CYLINDED CIRCUIT

BACKGROUND OF THE INVENTION

The invention relates to an arrangement for producing high hydraulic pressures, in particular for actuating a hydraulic press.

When generating and controlling high pressures, for instance above 400 bar, the local fluid heating at constrictions and throttle points, such as directional control valves, is very great and the wear at the throttle edges high. Also, the hydraulic amplification in valves with throttle edge control is very high and consequently pressure control systems tend to oscillate at such high pressures.

It has therefore already been proposed for the controlling of high pressures that the high pressure for the load or consumer be generated with a pressure intensifier or transmitter which has a differential piston and that the control or regulation of the pressure be carried out on the low-pressure side; this eliminates the valves on the high-pressure side. A disadvantage is however the necessary size of the pressure transmitter or intensifier, the high-pressure-side displacement of which must be made large enough to ensure that the displacement is always adequate for the consumer or load. It is assumed here that the fluid flow to the consumer must not be interrupted. This is for example the case in a press plant in which chemical-physical reactions are taking place. If after closure of the press mould or die by means of a conventional hydraulic system a predetermined pressure is reached then a predetermined pressure curve must be followed which requires a relatively slow pressure increase, whereupon a predetermined end pressure must be kept constant for a certain time; this operation can last a long time. Thereafter there is a slow pressure decrease until the press mould can be opened.

The problem underlying the invention resides in further developing the arrangement of the type outlined at the beginning so that very high pressures can be generated and exactly controlled. In particular, predetermined pressure values are to be generated in the form of pressure curves without any pressure collapses or discontinuities of the pressure.

SUMMARY OF THE INVENTION

According to the invention two pressure transmitters or intensifiers can have relatively small dimensions and are nevertheless able to provide a continuous pressure buildup at the load or consumer. When the first pressure intensifier has reached a predetermined position, in particular almost at the end of its stroke, via the opening shutoff valve fluid is forced into the high-pressure line by the second pressure intensifier. The stroke velocity of the second pressure intensifier is chosen so that the necessary fluid supply to the consumer occurrs and the excess fluid is taken up by the first pressure intensifier. The amount of fluid introduced by the second pressure intensifier must be large enough to cause the pressure in the high-pressure line to tend to rise. Since however a quite specific pressure is to be maintained the first pressure intensifier must yield and take up the excess fluid without the pressure increasing too much. The first pressure intensifier is thus replenished, whereupon the shutoff valve automatically closes again. The further pressure buildup is taken up by the first pressure intensifier and the second pressure intensifier is moved for filling up back to the standby position. The second pressure intensifier thus need not be regulated. It suffices for said pressure intensifier or transmitter to have a specific stroke velocity which of course is dependent on the absorption capacity of the consumer and the displacement of the pressure intensifier. The recharging or replenishing operation can be carried out as often as desired so that the two pressure intensifiers may have very small dimensions.

A pressure reduction is also possible with this arrangement. To discharge fluid from the consumer the first pressure intensifier is activated so that it yields. As soon as it has reached a maximum absorption volume the pressure in the chamber of the second pressure intensifier is raise by moving up the piston to the pressure increasing direction and the shutoff valve opened. The second pressure intensifier yields as quickly as possible and thereby takes up further fluid expelled by the consumer. The first pressure intensifier must now press fluid into the high-pressure line in order to maintain the pressure or to avoid too rapid a drop. The pressure intensifier thus discharges and the shutoff valve is thereupon again closed. This process can also be repeated as often as desired.

Thus, according to the invention the pressure control acts only on the very first pressure intensifier so that no switch-over of the control is necessary. The second pressure intensifier is driven with a constant velocity both in the pressure buildup and in the pressure reduction and said velocity is of a magnitude such that the fluid flow necessary for the consumer is maintained and the first pressure intensifier is recharged or discharged respectively.

It is also apparent from this explanation that the arrangement is equally well suited to other control purposes. Thus, instead of the pressure control circuit a velocity control circuit may be provided so that the consumer or load, for example a press, can be driven with a predetermined programmed stroke velocity. The pressure intensifiers are then activated in corresponding manner.

BRIEF DESCRIPTION OF THE DRAWINGS

An example of embodiment of the invention will be explained hereinafter with the aid of the drawings, wherein.

DETAILED DESCRIPTION OF THE PREFERRED EMBODIMENT OF THE INVENTION

Figure 1:
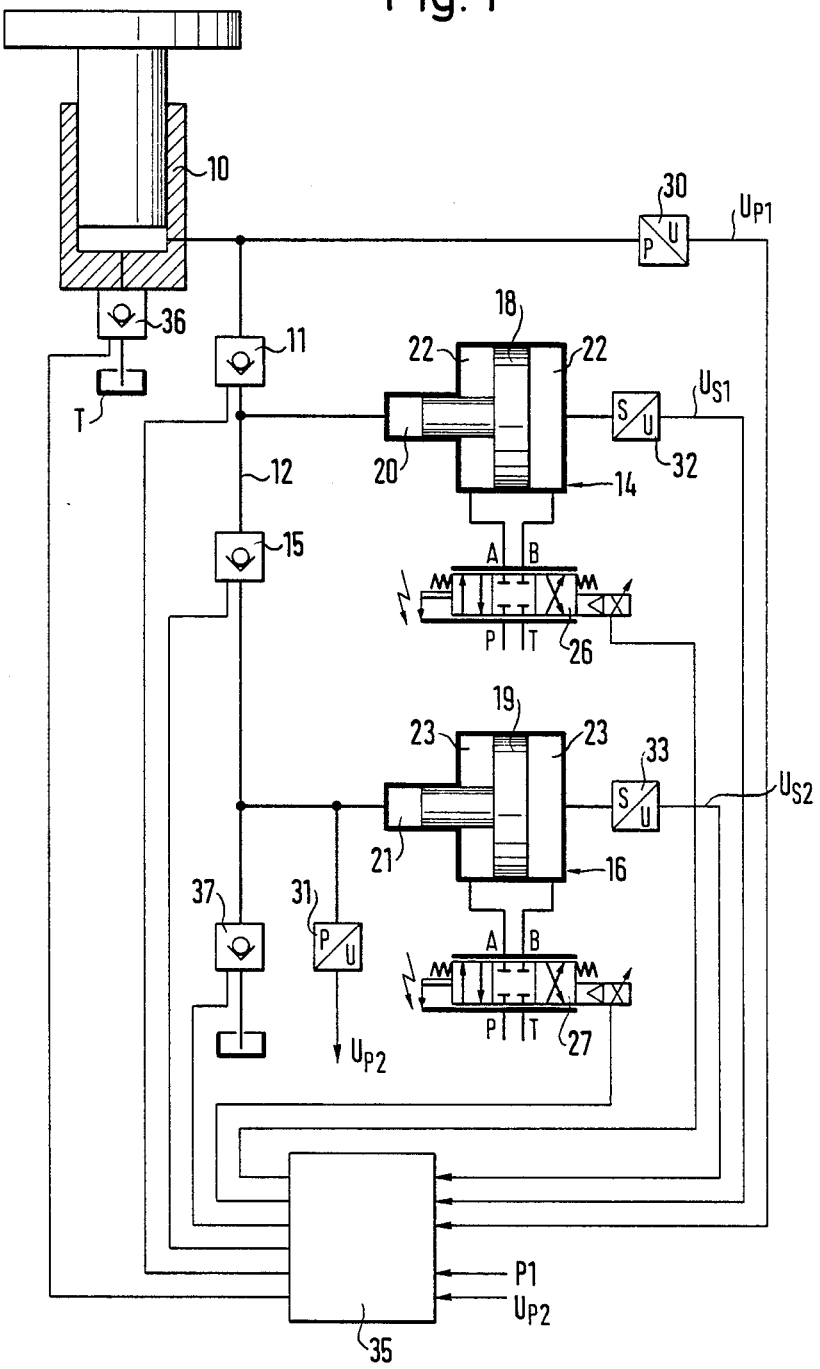
FIG. 1 is a general circuit diagram of the arrangement for a hydraulic press with a pressure control circuit and FIG. 2 is a schematic illustration of a press apparatus similar to FIG. 1.

In FIG. 1 a high-pressure line 12 is connected to a press cylinder 10 via a shutoff valve 11 and to this line 12 a first pressure intensifier 14 is connected; via a shutoff valve 15 a second pressure intensifier 16 is connected. Both pressure intensifiers or transmitters have a differential piston 18 and 19 respectively, the respective smaller piston face of which defines a high-pressure cylinder chamber 20 and 21 respectively and the larger piston face of which in each case defines a low-pressure cylinder chamber 22 and 23 respectively. The cylinder chambers 22 and 23 can be connected via a multiway proportional valve 26 and 27 respectively to a pump P or a tank T.

Connected to the high-pressure line 12 is a pressure pickup 30 which furnishes a signal corresponding to the actual value of the pressure $U_{P1}$ set in the press cylinder 10. The pressure in the high-pressure cylinder chamber 21 of the second pressure intensifier 16 is measured in a pressure pickup 31 which furnishes the actual value of the pressure $U_{P2}$.

The movement of the differential pistons 18 and 19 of the two pressure intensifiers 14 and 16 is measured in a respective displacement pickup 32 and 33, the output signals of which $U_{S1}$ and $U_{S2}$ correspond to the respective stroke of the differential piston 18 and 19.

All these signals are supplied to a closed-loop control circuit 35 which also receives a desired value for the pressure P1 to be set in the press cylinder 10. Said pressure desired values may for example be programmed so that starting from zero a pressure buildup takes place corresponding to a ramp, whereupon the pressure is kept constant and then the pressure is again reduced corresponding to a ramp.

The control circuit 35 drives the directional control valves 26 and 27, which are shown in the form of 4/3 directional control proportional valves, as well as the shutoff valves 11, 15 and 37 and a further shutoff valve 36 which is connected to the press cylinder 10 and leads to the tank T.

The mode of operation is as follows:

The shutoff valve 11 is usually always open and is only closed in case of trouble to protect the press. In the starting position it is assumed that the pressure in the press cylinder 10 is equal to zero and the two pressure intensifiers 14 and 16 are moved via the directional control valves 26, 27 into the right position in which the volume in the high-pressure cylinder chambers 20 and 21 is a maximum. The pressure intensifiers are thus filled on the high-pressure side.

To build up the pressure in the press cylinder 10 the directional control valve 26 is activated and the differential piston 18 on the low-pressure side actuated. The differential piston 18 moves in accordance with a pressure buildup curve which is defined by the desired value P1 and the actual value $U_{P1}$ of which is detected by the pressure pickup 30.

Once the differential piston 18 has moved to the left to such an extent that the high-pressure cylinder chamber 20 only has a minimum volume the signal $U_{S1}$ furnished by the displacement pickup 32 causes the control circuit 35 to drive the directional control valve 27 of the second pressure intensifier 16 in such a manner that the differential piston 19 is displaced with a predetermined relatively high velocity so that fluid is forced into the high-pressure line 12 and in addition the differential piston 18 of the first pressure intensifier 14 is pushed back. The yielding of the differential piston 18 is effected by corresponding activation of its low-pressure side by means of the directional control valve 26 which is disposed in the pressure control circuit and the actual value of which is detected by the pressure pickup 30. This ensures that the differential piston 18 always yields so that the desired pressure in the high-pressure line 12 is maintained. Moreover, the pressure buildup in the form of a ramp must be so small in the replenishing compared with the displacement velocity of the second pressure intensifier 16 that the pressure control system for the high-pressure line and thus for the press cylinder 10 is able to level out any interfering pressure occurring on actuation of the second pressure intensifier 16.

When the differential piston 19 of the second pressure intensifier 16 has reached its front end position and the control circuit 35 receives from the displacement pickup 33 the corresponding signal $U_{S2}$ the differential piston 19 is pushed back as quickly as possible to its starting position, fluid being introduced into the chamber 21 via the replenishment valve 37. Once the differential piston 19 has reached its right end position corresponding to the maximum volume of the chamber 21, i.e. is in standby position, a further replenishment operation can take place in the manner already described. This operation is continued until the pressure buildup is completed.

If the press cylinder 10 is to perform a pressure holding phase and because of leakage over a relatively long period of time fluid is lost from the press cylinder 10, the necessary pressure is compensated by following up the first pressure intensifier 14. If the differential piston 18 then reaches the front end position this is detected by the displacement pickup 32 and the replenishing operation starts again by the shutoff valve 15 being opened and the differential piston 19 being moved out of its standby position to force fluid into the high-pressure line 12.

For pressure relief of the press cylinder 10 a preprogrammed pressure ramp is also regulated by means of the pressure control circuit acting via the directional control valve 26 on the first pressure intensifier 14. The movement operations of the two pressure intensifiers are then the converse.

Starting from the front end position with a minimum volume in the chamber 20 the differential piston 18 is pushed back until the absorption capacity in the chamber 20 is exhausted.

To prepare the second pressure intensifier 16 for receiving excess fluid, prior to the start of the pressure relief phase any charging operation which might still be running is interrupted. The chamber 21 is rendered pressureless by moving back the differential piston 19. Thereafter the differential piston 19 is stopped until the replenishment valve 37 is opened and subsequently the differential piston 19 is moved into a front standby position. The replenishment valve 37 is then closed.

If the pressure intensifier 14 is now in the position in which it cannot take up any more fluid a signal is passed via the displacement pickup 32 to the control circuit 35 which first initiates a pressure buildup in the chamber 21 of the second pressure intensifier 16 by appropriately activating the directional control valve 27. If the pressure in the chamber 21 detected by the pressure pickup 31 is equal to the pressure at the pressure pickup 30 the shutoff valve 15 is opened and the differential piston 19 of the second pressure pickup 16 moved as rapidly as possible rearwardly. When this is done, as in the charging operation, an acceleration and delay ramp for the stroke velocity of the differential piston 19 performs its function to give the pressure control circuit for the high-pressure line 12 time for levelling out any pressure interference quantity which might occur. Once the pressure intensifier 16 has reached a predetermined rear position the shutoff valve 15 is closed and the differential piston 19 moved further beyond the predetermined position into the end position so that the pressure in the chamber 21 can be reduced. When this pressure reduction has been achieved, being detected by the pressure pickup 31, the replenishment or suction valve 37 is opened and the differential piston 19 is displaced as rapidly as possible in the opposite direction, the fluid thereby being expelled from the chamber 21 via the valve 37 to the tank until the differential piston 19 has reached its front standby position in which the valve 37 is closed.

The second pressure intensifier is thus again ready for operation and the process outlined can be repeated as soon as the first pressure intensifier 14 has reached its maximum absorption volume. The discharging operation is continued until the pressure in the press cylinder 10 has been completely reduced and the valve 36 can be opened.

With the arrangement pressures over 700 bar can be produced and controlled. No control devices or pumps at all are necessary in the high-pressure section. In the high-pressure section only simple functions such as actuating the shutoff valve 15 are performed. The wear is substantially reduced and overheating in the fluid on the high-pressure side also avoided.

Figure 2:
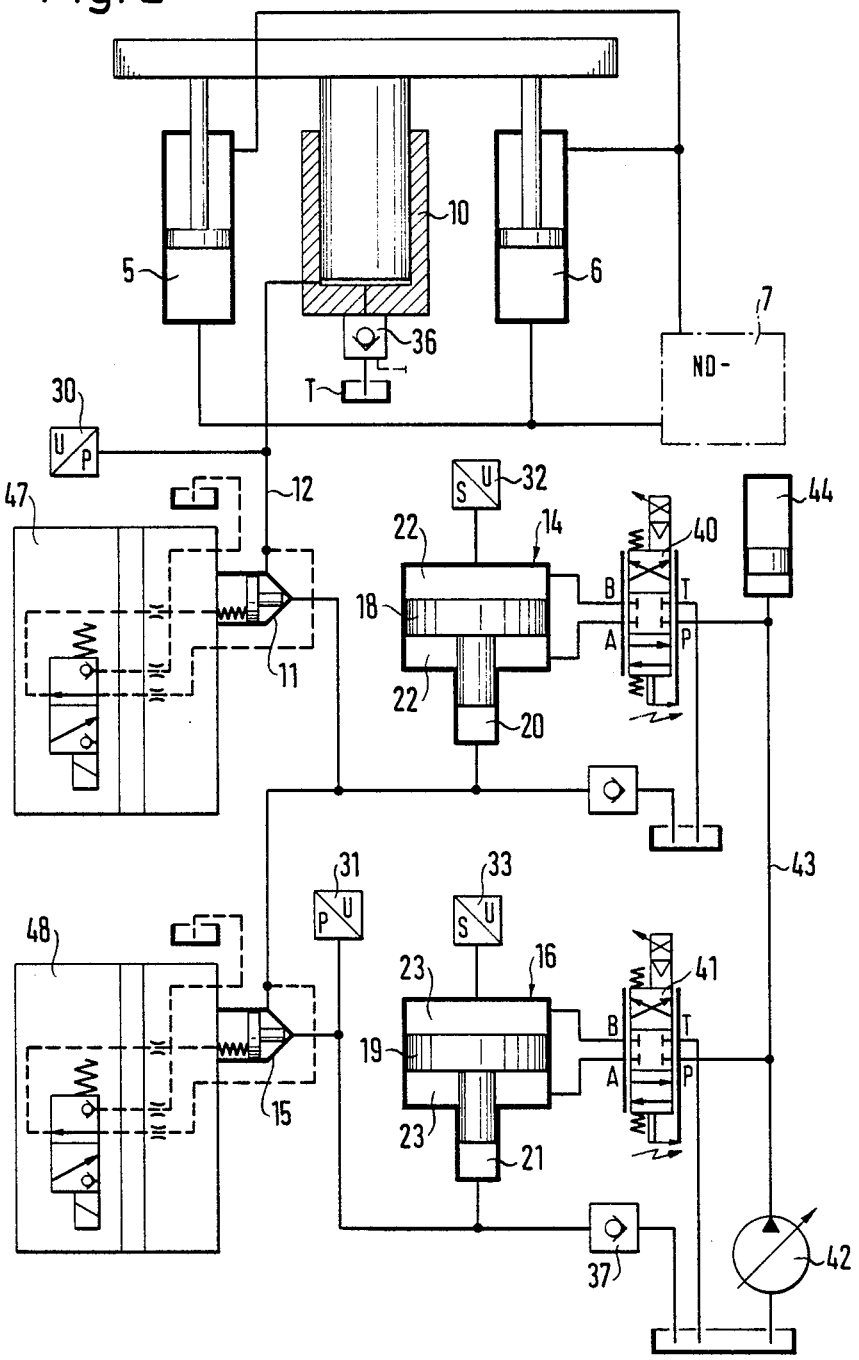

FIG. 2 shows the hydraulic circuit for the press cylinder 10 in somewhat more detail, the same components being denoted by the same reference numerals. This is a press of which the details are not illustrated. The press mould is moved up by means of conventional hydraulic cylinders 5 and 6 using a low-pressure control 7 at fast speed. When a predetermined low pressure is reached in the approach the further pressure buildup and the pressure relief are governed by the pressure of the press cylinder 10. Details of this system are not shown.

In FIG. 2 as proportional directional control valves servo directional control valves 40, 41 are provided. This simplifies the pressure control on the low-pressure side because no pressure valves tending to oscillate are present.

The supply with low pressure is by a pump 42 advantageously constructed as variable displacement pump for controlling the operating pressure. To equalize pressure fluctuations a pressure accumulator 44, preferably a piston accumulator, is connected to the low-pressure line 43 and the pressure range thereof can be made as large as desired. Also provided in the high-pressure line 12 is a simple replenishing or suction valve whose only purpose is to prevent on malfunction of the control a vacuum arising in the chamber 20 of the pressure intensifier 14.

Furthermore, in FIG. 2 the activation of the shutoff valves 11 and 15 is also illustrated. These are 2/2-way seat valves of known construction which can be activated for closing and opening by a pilot operated valve 47 or 48. The control of the pilot operated valves is also effected by the control circuit 35 illustrated in FIG. 1. Whereas the shutoff valve 11 is normally always open and only serves as safety valve, the shutoff valve 15 is a releasable check valve which frees the passage from the pressure intensifier 16 to the pressure intensifier 14 and conversely blocks the high-pressure line 12 to the second pressure intensifier 16 or likewise releases it in the activated state.

The replenishment suction valve 37 is activated by a similar valve not illustrated here. This pilot-operated valve is also controlled by the control circuit 35 illustrated in FIG. 1.

I claim:

1. Arrangement for producing high hydraulic pressures in a high pressure line for a load comprising first and second mechanically independent pressure intensifiers each having a differential piston having a smaller effective area piston face and larger effective area piston face, a respective high pressure cylinder chamber defined in part by its respective smaller piston face and connected to said high pressure line, and a respective low-pressure cylinder chamber defined in part by its respective larger piston face; independent means for selectively communicating each of said lower pressure chambers via a respective directional control valve to a low-pressure fluid source or a tank, each of said differential pistons being moveable between a first retracted position and a second forward position, characterized in that valve means are provided for at least partially filling said high-pressure cylinder chamber of said first pressure intensifier from a portion the volume displaced in actuating said second pressure intensifier for returning said differential piston of said first pressure intensifier to said first position when said second pressure intensifier is pressuring said high pressure line through its controlled movement and for connecting high-pressure cylinder chamber of said second pressure intensifier to said low-pressure fluid source or tank for refilling when said differential piston of said second pressure intensifier is returned to its first position.

2. Arrangement of claim 1, characterized in that valve means includes a releasable check valve for connecting the high-pressure cylinder chambers of said first and second pressure intensifiers to each other.

3. Arrangement of claim 1, characterized in that said valve means includes a first releasable check valve for connecting said high-pressure cylinder chamber of said first pressure intensifier to said high pressure line and a second releasable check valve for communicating said high-pressure cylinder chamber of said second pressure intensifier to the tank.

4. Arrangement according to claim 1, characterized in that the directional control valve for the first pressure intensifier is operated by a closed-loop control circuit.

5. Arrangement according claim 4 characterized in that the control circuit is a pressure control circuit for the high pressure line.

6. Arrangement according to claim 4, characterized in that the control circuit is a speed control circuit for a consumer served by the high pressure line.

7. Arrangement according to claim 1, characterized in that a control means drives the second pressure intensifier so that the differential piston of the second pressure intensifier executes a predetermined stroke velocity.

8. Arrangement according to claim 7, characterized in that the stroke velocity of the second pressure intensifier is variable.

9. Arrangement according to claim 7, characterized in that the differential piston of the second pressure intensifier is accelerated slowly to its final velocity and retarded slowly from the final velocity by the operation of the control means.

10. Arrangement according to claim 1, characterized in that the stroke velocity for the second pressure intensifier is such that in addition to the exchange of fluid between a consumer served by the high pressure line and the high pressure cylinder chamber of the second pressure intensifier excess fluid is exchanged with the high-pressure cylinder chamber of the first pressure intensifier.

11. Arrangement according to claim 10, characterized in that in the exchange of fluid the pressure in the high-pressure line is maintained at a predetermined value.

12. Arrangement according to claim 11, characterized in that the predetermined value is constant.

13. Arrangement according to claim 11, characterized in that the predetermined value is variable.

14. Arrangement according to claim 13, characterized in that the variable values are defined by curves programmed into the control means derived from corresponding desired values.

15. Arrangement according to claim 10, characterized in that a velocity of the consumer is controlled to a predetermined value.

16. Arrangement according to claim 1, characterized in that the pressure intensifiers are each provided with a displacement pickup.

17. Arrangement according to claim 1, characterized in that a pressure pickup in connected to the high-pressure line.

18. Arrangement according to claim 17, characterized in that a pressure pickup is connected to the second pressure intensifier.

19. Arrangement according to claim 1, characterized in that the valve means comprises a two port, two position shutoff seat valve.

20. Arrangement according to claim 19, characterized in that between the high-pressure cylinder chamber of the first pressure intensifier and a consumer served by the high pressure line a further shutoff valve is provided.

21. Arrangement according to claim 1, characterized in that the low-pressure directional control valves are directional control servo valves.

* * * * *